United States Patent [19]

Akabane

[11] 4,026,088

[45] May 31, 1977

[54] WINDOW PANE HOLDER

[75] Inventor: Morizi Akabane, Atsugi, Japan

[73] Assignee: Hori Glass Co., Ltd., Japan

[22] Filed: Aug. 19, 1976

[21] Appl. No.: 715,828

[30] Foreign Application Priority Data

Aug. 20, 1975 Japan ..... 50-114734[U]

[52] U.S. Cl. ..... 52/628; 49/351

[51] Int. Cl.² ..... E05F 11/44

[58] Field of Search ..... 52/627, 208, 202, 203, 52/400, 399, 656, 616, 397, 398, 304, 624, 628; 49/350, 351, 349, 348, 391

[56] References Cited

UNITED STATES PATENTS

| | | | |
|---|---|---|---|
| 2,168,242 | 8/1939 | Roethel | 49/351 |
| 2,575,655 | 11/1951 | Clerk | 52/398 |
| 3,252,256 | 5/1966 | Sprecher | 52/208 |
| 3,281,297 | 10/1966 | Schmidt | 52/616 |
| 3,373,528 | 3/1968 | Tinder | 49/349 |
| 3,888,047 | 6/1975 | Chikaraishi | 49/351 |
| 3,889,434 | 6/1975 | Shelver | 52/616 |

FOREIGN PATENTS OR APPLICATIONS

| | | | |
|---|---|---|---|
| 885,224 | 11/1971 | Canada | 52/398 |

*Primary Examiner*—John E. Murtagh

*Attorney, Agent, or Firm*—Robert E. Burns; Emmanuel J. Lobato; Bruce L. Adams

[57] ABSTRACT

A window pane holder which retains the bottom end of a window pane, slidably mounted in a sash on a door of an automotive vehicle, and which is connected with an elevating unit for lifting and lowering the window pane. The holder comprises a framework formed of a hard synthetic resin and including a pair of opposite sidewalls and a bottom, the sidewalls defining a slot therebetween for receiving the window pane. The holder also comprises an extension downwardly depending from the framework. At least in the end portions of the slot, the pair of sidewalls are provided with ribs extending into such slot portions and having surfaces which are adapted to bear against the window pane as it is received into the slot so as to leave a clearance between the sidewalls and the window pane in which to receive an adhesive.

2 Claims, 4 Drawing Figures

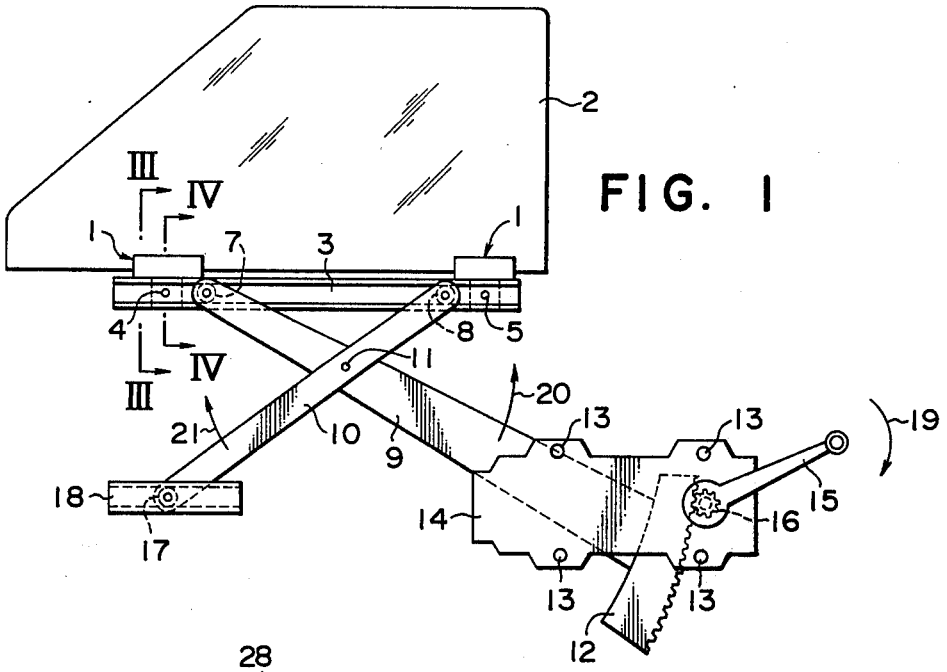
FIG. 1
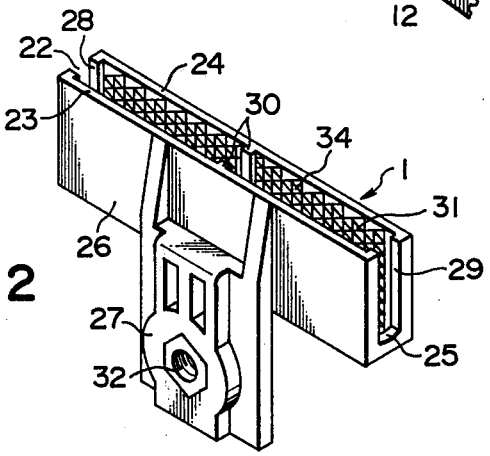
FIG. 2
FIG. 3
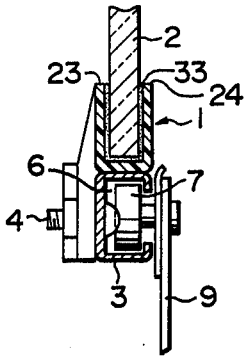
FIG. 4
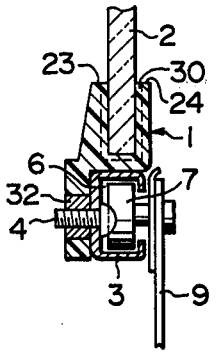

WINDOW PANE HOLDER

FIELD AND BACKGROUND OF THE INVENTION

The invention relates to a window pane holder for vehicles, and more particularly, to a window pane holder for retaining the bottom end of a window pane slidably mounted in a sash on a door of a vehicle and connected with an elevating unit for lifting and lowering the window pane.

In known holders of this kind, a relatively tight engagement is maintained between the window pane and the sash, and this causes a tension of an appreciable magnitude to be exerted by one of the cooperating members upon the other when lowering the window pane. As a consequence, the holder must have a firm grip on the window pane. A conventional holder comprise a frame which is pressed from a metal sheet of a length commensurate with the width of the window pane into a channel-shaped cross section having a slot width or lateral separation which is substantially equal to the thickness of the window pane. One of the sidewalls of the frame has a pair of legs welded thereto at its axial ends for connection with an elevating unit. When mounting the window pane in the frame, the frame portion defining the slot is lined with a rubber sheet before the pane is forcibly fitted into the slot, thus retaining it in place under the inward resilience of the rubber lining. Soapsuds or other drying lubricant must be applied to either the inner surface of the lining or the lower margin of the pane when fitting the latter in order to assure a smooth sliding therebetween.

When these conventional holders are used, any distortion in the frame may result in a failure to provide a tight fit into the holder or a disengagement of the pane therefrom inasmuch as the pane is held in place by utilizing the resilience of the frame over its entire length, and indeed the frame is often susceptible to such deformation because of its increased length extending along substantially the full length of the window pane. In addition, the number of manufacturing steps required for the described holder construction disadvantageously increases the overall cost.

SUMMARY OF THE INVENTION

It is an object of the invention to provide a window pane holder for vehicles which is capable of firmly retaining a window pane.

It is another object of the invention to provide a window pane holder which can be easily and inexpensively manufactured in simple manufacturing steps.

In accordance with the invention, the holder comprises a framework molded from a hard synthetic resin in a known manner so as to have a pair of opposite sidewalls defining therebetween a slot for receiving the bottom end of a window pane and a bottom, and an extension downwardly depending from substantially the middle of one of the sidewalls and having substantially T-shaped configuration in front view. When mounting a window pane of standard size for automobile use, a pair of such holders are attached to the bottom end thereof at spaced points. Each holder is arranged such that the window pane is adhesively retained within the slot formed between the pair of sidewalls while avoiding the use of the rubber lining. At this end, the inner surface of the opposite sidewalls of each holder is formed with ribs thereon adjacent to their opposite ends, the ribs enabling an adhesive to be introduced into the slot and preventing it from being extruded to the exterior. The ribs have their surface maintained in contact with the pane so as to hold it in a frictional manner, and also serve reinforcing the sidewalls in order to avoid any distortion thereof. Additional ribs of similar construction may be provided on the sidewalls in the intermediate region of the slot. A number of small protuberances may also be formed on the sidewalls in the intermediate region of the slot in order to improve the adhesion between the pane and the sidewalls.

As mentioned above, the holder of the invention includes a framework of a reduced length which grips part of the bottom end of the window pane. The slot is formed in the framework for receiving the pane, which is only engaged by the surface of ribs which are formed at least the opposite ends of the slot, thus leaving a clearance between the pane and the sidewalls in the region intermediate the ribs for permitting introduction of an adhesive thereinto. When the pane is fitted into the slot and the adhesive poured into the clearance, the ribs closes the clearance to prevent an eggress thereof, thus contributing to a uniform distribution of the adhesive across the entire slot area. In this manner, a firm bonding is assured between the pane and the holder. Since the ribs represent the only location which is engaged by the pane upon insertion thereof, the fitting of the pane is facilitated. The connection of the holder with only a portion of the pane prevents any tendency of exfoliation of the adhesive from either the pane or the holder in the event a bending stress is applied to the pane to cause its flexure.

BRIEF DESCRIPTION OF THE DRAWINGS

FIG. 1 is a front view of the window pane holder of the invention shown in combination with a known form of an elevating unit;

FIG. 2 is a perspective view of the holder of FIG. 1;

FIG. 3 is a cross section taken along the line III—III shown in FIG. 1; and

FIG. 4 is a cross section taken along the line IV—IV shown in FIG. 1.

DESCRIPTION OF PREFERRED EMBODIMENT

Referring to FIG. 1, the holder according to the invention is generally indicated by a reference character 1. It will be noted that a pair of holders 1 are graspingly engaged with the bottom end of a window pane 2 adjacent to its opposite ends, which is slidably mounted in a sash on a door, not shown, of an automobile. The holders 1 are secured by set screws 4, 5 to a movable guide rail 3 of a window pane elevating unit of any known form which is also housed within the door. The guide rail 3 has a channel groove 6 for receiving therein a pair of rollers 7, 8 which are pivotally mounted on the free end of a pair of master and slave arms 9, 10 which, are in turn pivotally crosslinked on a stationary pin 11 secured to the door, not shown. The other end of the master arm 9 fixedly carries an arcuate rack 12 which is disposed for meshing engagement with a pinion 16 on a shaft, not shown, carried by and integral with a handle 15. By the shaft just mentioned, the handle is pivotally mounted on a plate 14 which is secured to the inside of the door (not shown) by set screws 13. The other end of the slave arm 10 rotatably carries a roller 17 which is received in a channel groove of a stationary guide rail 18 secured to the inside of the door, not shown. The guide rail 18 is disposed in parallel relationship with the movable guide rail 3.

From the foregoing description, it will be appreciated that when the handle 15 is turned in the direction of arrow 19 shown in FIG. 1, the master arm 9 moves angularly about the pin 11 in the direction of arrow 20 while the slave arm 10 moves angularly about the pin 11 in the direction of arrow 21, whereby the movable guide rail 3 descends to lower the window pane 2 through the holders 1. An angular movement of the handle 15 in the opposite direction from the direction indicated by the arrow 19 will lift or raise the pane 2.

FIG. 2 shows one embodiment of the holder 1 in detail. The holder comprises a framework 26 molded from a known synthetic resin and including a pair of opposite sidewalls 23, 24 defining therebetween an elongated slot 22 and a bottom 25, and an extension 27 downwardly depending from one of the sidewalls 23, and having a substantially T-shaped configuration in front view. At its opposite ends and its middle portion, the sidewalls 23, 24 are formed with ribs 28, 29 and 30 which are normal to the longitudinal axis of the slot and extend toward the other sidewall, and in addition, a number of small protuberances 34 are formed on the sidewalls to define bonding surfaces 31. A metal nut 32 is embedded in the extension 27 for threadably securing the holder 1 to the movable guide rail 3 of the window pane elevating unit.

FIGS. 3 and 4 illustrate the window pane 2 retained by the holder 1 of the invention. It will be seen that the surface of the pane 2 is in contact with the bottom 25 and the ribs 28 to 30. An adhesive 33 is poured into the clearance formed between the sidewalls 23, 24 and the pane 2 in the region intermediate the ribs. The adhesive 33 achieves an intimate adherence to the surface of the pane 2 on one hand while tightly adhering to the bonding surfaces 31 formed by the protuberances on the other hand. It is to be realized that such a perfect adhesion is achieved by merely fitting the pane 2 into the slot 22 and pouring the adhesive 33 into the clearance between the sidewalls 23, 24 and the pane 2, since the ribs 28 to 30 act to close the discharge outlet for the adhesive 33, which is therefore distributed or extended across the entire area of the sidewalls 23, 24 delineated by the ribs 28 to 30.

Having described the invention, what is claimed is:

1. A window pane holder for use in providing a connection between a window pane of a vehicle and a window pane elevating unit which lifts and lowers the window pane; the holder being formed of a hard synthetic resin and comprising a framework having a pair of opposite sidewalls defining therebetween an elongated slot for receiving the window pane therein and a bottom, and an extension downwardly depending from the framework and including connection means with the elevating unit, the pair of sidewalls being provided with ribs thereon at least at their opposite ends, the ribs on one of the sidewalls being normal to a longitudinal axis of said slot and extending toward the other sidewall and bearing against the surface of the window pane as it is received into the slot, thereby forming a clearance between the sidewalls and the pane in the region intermediate the ribs so as to receive an adhesive therein.

2. A window pane holder according to claim 1 in which in the region intermediate the ribs, the pair of sidewalls are formed with a number of small protuberances thereon which define bonding surfaces.

* * * * *